US011705067B2

(12) United States Patent
Kim

(10) Patent No.: US 11,705,067 B2
(45) Date of Patent: Jul. 18, 2023

(54) ORGANIC LIGHT EMITTING DIODE DISPLAY DEVICE

(71) Applicant: SAMSUNG DISPLAY CO., LTD., Yongin-si (KR)

(72) Inventor: Taegon Kim, Busan (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 81 days.

(21) Appl. No.: 17/078,333

(22) Filed: Oct. 23, 2020

(65) Prior Publication Data

US 2021/0158758 A1 May 27, 2021

(30) Foreign Application Priority Data

Nov. 21, 2019 (KR) ..... 10-2019-0150333

(51) Int. Cl.

| | |
|---|---|
| ***G09G 3/3258*** | (2016.01) |
| ***G09G 3/3291*** | (2016.01) |
| ***G09G 3/3266*** | (2016.01) |
| ***G09G 3/20*** | (2006.01) |

(52) U.S. Cl.

CPC ..... *G09G 3/3258* (2013.01); *G09G 3/2092* (2013.01); *G09G 3/3266* (2013.01); *G09G 3/3291* (2013.01); *G09G 2310/0286* (2013.01); *G09G 2310/0289* (2013.01); *G09G 2310/0291* (2013.01); *G09G 2330/028* (2013.01)

(58) Field of Classification Search

CPC .. G09G 3/3258; G09G 3/2092; G09G 3/3266; G09G 3/3291; G09G 2310/0286; G09G 2310/0289; G09G 2310/0291; G09G 2330/028

See application file for complete search history.

(56) References Cited

U.S. PATENT DOCUMENTS

2010/0060619 A1* 3/2010 Kim ..... G09G 3/3659 345/98
2010/0295834 A1* 11/2010 Kim ..... G09G 3/3208 307/41
2012/0062130 A1* 3/2012 Ono ..... G09G 3/3233 315/192
2012/0262440 A1* 10/2012 Zhao ..... G09G 3/3677 345/212
2015/0170574 A1* 6/2015 Kim ..... G09G 3/3233 345/76

(Continued)

FOREIGN PATENT DOCUMENTS

KR 10-0748320 8/2007
KR 10-2009-0093019 9/2009

(Continued)

*Primary Examiner* — Chanh D Nguyen
*Assistant Examiner* — Ngan T. Pham-Lu
(74) *Attorney, Agent, or Firm* — F. Chau & Associates, LLC

(57) ABSTRACT

An organic light emitting diode (OLED) display device includes a first power supply circuit configured to generate a pixel driving voltage, a display panel configured to receive the pixel driving voltage from the first power supply circuit, and including a plurality of pixels each configured to emit light based thereon, and a scan driver configured to receive the pixel driving voltage from the display panel, and to provide scan signals based on the pixel driving voltage to the plurality of pixels.

17 Claims, 10 Drawing Sheets

(56) References Cited

U.S. PATENT DOCUMENTS

| | | | | |
|---|---|---|---|---|
| 2016/0180763 | A1* | 6/2016 | Park | G09G 3/3258<br>345/691 |
| 2018/0301518 | A1* | 10/2018 | Zhu | G09G 3/3208 |
| 2018/0315369 | A1* | 11/2018 | Pyun | G09G 3/2092 |
| 2018/0322843 | A1* | 11/2018 | Takahashi | G09G 3/3611 |
| 2020/0213543 | A1* | 7/2020 | Ofuji | G01T 1/208 |

FOREIGN PATENT DOCUMENTS

| | | |
|---|---|---|
| KR | 10-1050465 | 7/2011 |
| KR | 10-1844701 | 3/2018 |

* cited by examiner

ORGANIC LIGHT EMITTING DIODE DISPLAY DEVICE

CROSS-REFERENCE TO RELATED APPLICATION

This application claims priority under 35 USC § 119 to Korean Patent Application No. 10-2019-0150333, filed on Nov. 21, 2019 in the Korean Intellectual Property Office (KIPO), the disclosure of which is incorporated herein by reference in its entirety.

TECHNICAL FIELD

The present disclosure relates generally to display devices, and more particularly to organic light emitting diode (OLED) display devices.

DISCUSSION OF RELATED ART

A scan driver of an OLED display device may receive a gate on voltage through a single gate on voltage line from a power supply circuit, and may output the gate on voltage as a scan signal. However, due to a voltage drop (e.g., an IR drop) at the single gate on voltage line, the gate on voltage may be decreased as a distance from the power supply circuit increases. Accordingly, the scan signal output from the scan driver may not have a uniform voltage level, and thus a display quality of the OLED display device may be degraded. Further, as a size of a display panel of the OLED display device increases, a voltage level difference between the scan signal at a position close to the power supply circuit and the scan signal at a position distant from the power supply circuit may be increased, and thus the display quality of the OLED display device may be further degraded.

SUMMARY

Exemplary embodiments of the present disclosure provide an organic light emitting diode (OLED) display device capable of maintaining substantially uniform scan signal voltages.

According to an exemplary embodiment, there is provided an OLED display device including a first power supply circuit configured to generate a pixel driving voltage, a display panel configured to receive the pixel driving voltage from the first power supply circuit, and including a plurality of pixels each configured to emit light based thereon, and a scan driver configured to receive the pixel driving voltage from the display panel, and configured to provide scan signals based on the pixel driving voltage to the plurality of pixels.

In an exemplary embodiment, the display panel may further include power wiring for transferring the pixel driving voltage to the plurality of pixels. The scan driver may receive the pixel driving voltage through the power wiring of the display panel from the first power supply circuit.

In an exemplary embodiment, the power wiring of the display panel may have a grid or mesh structure.

In an exemplary embodiment, each of the plurality of pixels may include a switching transistor configured to transfer a data voltage in response to the pixel driving voltage provided from the scan driver, a storage capacitor configured to store the data voltage transferred through the switching transistor, a driving transistor coupled to the power wiring, and configured to generate a driving current corresponding to the data voltage stored in the storage capacitor based on the pixel driving voltage provided through the power wiring, and an OLED configured to emit light based on the driving current.

In an exemplary embodiment, the OLED display device may further include a second power supply circuit configured to generate a gate off voltage. The scan driver may further receive the gate off voltage from the second power supply circuit, may output the pixel driving voltage as the scan signals having an on level, and may output the gate off voltage as the scan signals having an off level.

In an exemplary embodiment, the OLED display device may further include a controller configured to control the scan driver by providing a scan start signal and a scan clock signal to the scan driver.

In an exemplary embodiment, the scan driver may include a shift register configured to sequentially generate internal scan signals by shifting the scan start signal in response to the scan clock signal, and an output buffer circuit configured to receive the pixel driving voltage from the first power supply circuit, to further receive the gate off voltage from the second power supply circuit, to output the pixel driving voltage as the scan signals having the on level in response to the internal scan signals, and to output the gate off voltage as the scan signals having the off level.

In an exemplary embodiment, the second power supply circuit may further generate a digital high-level power supply voltage and a digital low-level power supply voltage. The shift register may operate based on the digital high-level power supply voltage and the digital low-level power supply voltage received from the second power supply circuit.

In an exemplary embodiment, the scan driver may further include a level shift circuit configured to receive the pixel driving voltage from the first power supply circuit, to increase a voltage level of the internal scan signals output from the shift register based on the pixel driving voltage, and to provide the output buffer circuit with the internal scan signals having the increased voltage level.

In an exemplary embodiment, the display panel may further include a power wiring for transferring the pixel driving voltage to the plurality of pixels. The first power supply circuit may apply the pixel driving voltage to the power wiring of the display panel through a first power supply line. The scan driver may receive the pixel driving voltage through the first power supply line and the power wiring of the display panel from the first power supply circuit.

In an exemplary embodiment, the OLED display device may further include a source driver configured to provide data voltages to the plurality of pixels, a first source film coupled to the display panel, the source driver disposed on the first source film, a first source board coupled to the first source film, a first flexible film coupled to the first source board, a control board coupled to the first flexible film, a second flexible film coupled to the control board, and a power board coupled to the second flexible film, the first power supply circuit disposed on the power board. The first power supply line may be formed on the power board, the second flexible film, the control board, the first flexible film, the first source board and the first source film.

In an exemplary embodiment, the first source film may be coupled to a first side of the display panel. The first power supply circuit may apply the pixel driving voltage to the power wiring at the first side of the display panel through the first power supply line, and may further apply the pixel driving voltage to the power wiring at a second side opposite to the first side of the display panel through a second power supply line.

In an exemplary embodiment, the OLED display device may further include a second source film coupled to the second side of the display panel, the source driver being not disposed on the second source film, a second source board coupled to the second source film, and a third flexible film coupling the second source board and the control board. The second power supply line may be coupled to the first power supply line on the control board, and may be formed on the third flexible film, the second source board and the second source film.

According to an exemplary embodiment, there is provided an OLED display device including a display panel including a plurality of pixels, and a power wiring for transferring a pixel driving voltage to the plurality of pixels, a source driver configured to provide data voltages to the plurality of pixels, a source film coupled to the display panel, the source driver disposed on the source film, a source board coupled to the source film, a first flexible film coupled to the source board, a control board coupled to the first flexible film, a second flexible film coupled to the control board, a first power supply circuit configured to generate the pixel driving voltage, a power board coupled to the second flexible film, the first power supply circuit disposed on the power board, a power supply line formed on the power board, the second flexible film, the control board, the first flexible film, the source board and the source film, and configured to apply the pixel driving voltage generated by the first power supply circuit to the power wiring of the display panel, and a scan driver configured to receive the pixel driving voltage through the power supply line and the power wiring of the display panel from the first power supply circuit, and to provide the pixel driving voltage as scan signals to the plurality of pixels.

In an exemplary embodiment, the OLED display device may further include a scan film coupled to the display panel. The scan driver may be implemented as a scan integrated circuit disposed on the scan film.

In an exemplary embodiment, the scan driver may be integrated in a peripheral portion of the display panel.

In an exemplary embodiment, the OLED display device may further include a second power supply circuit disposed on the control board, and configured to generate a gate off voltage. The scan driver may further receive the gate off voltage from the second power supply circuit, may output the pixel driving voltage as the scan signals having an on level, and may output the gate off voltage as the scan signals having an off level.

According to an exemplary embodiment, there is provided an OLED display device including a display panel including a plurality of pixels, and a power wiring for transferring a pixel driving voltage to the plurality of pixels, a source driver configured to provide data voltages to the plurality of pixels, a first source film coupled to a first side of the display panel, the source driver disposed on the first source film, a first source board coupled to the first source film, a first flexible film coupled to the first source board, a control board coupled to the first flexible film, a second flexible film coupled to the control board, a first power supply circuit configured to generate the pixel driving voltage, a power board coupled to the second flexible film, the first power supply circuit disposed on the power board, a first power supply line formed on the power board, the second flexible film, the control board, the first flexible film, the first source board and the first source film, and configured to apply the pixel driving voltage to the power wiring at the first side of the display panel, a second source film coupled to a second side opposite to the first side of the display panel, the source driver being not disposed on the second source film, a second source board coupled to the second source film, a third flexible film coupling the second source board and the control board, a second power supply line coupled to the first power supply line on the control board, formed on the third flexible film, the second source board and the second source film, and configured to apply the pixel driving voltage to the power wiring at the second side of the display panel, and a scan driver configured to receive the pixel driving voltage through the first power supply line and the power wiring of the display panel from the first power supply circuit, to further receive the pixel driving voltage through the second power supply line and the power wiring of the display panel from the first power supply circuit, and to provide the pixel driving voltage as scan signals to the plurality of pixels.

In an exemplary embodiment, the OLED display device may further include a scan film coupled to the display panel. The scan driver may be implemented as a scan integrated circuit disposed on the scan film.

In an exemplary embodiment, the scan driver may be integrated in a peripheral portion of the display panel.

As described above, in an OLED display device, for example, a scan driver may receive a pixel driving voltage provided to a plurality of pixels, and may provide the pixel driving voltage as scan signals to the plurality of pixels. Accordingly, the pixel driving voltage having a relatively small voltage drop may be used instead of a gate on voltage having a relatively large voltage drop in the scan driver, and the number of lines (or wirings) and a bezel width of the OLED display device may be reduced.

According to an exemplary embodiment, a display panel is provided including a power distribution circuit having at least one power supply terminal and a plurality of output terminals; a plurality of pixels connected to the plurality of output terminals; and at least one scan power line connected to at least one of the plurality of output terminals.

In an exemplary embodiment, the display panel may be configured wherein the plurality of pixels are arranged in a multi-dimensional matrix, and the power distribution circuit extends along each orthogonal dimension of the matrix and is interconnected at each vertex of the matrix.

In an exemplary embodiment, the display panel may further include a plurality of scan signal lines each connected to a plural single-dimensional subset of the plurality of pixels, wherein each of the plurality of scan signal lines is switchably connected to the at least one scan power line.

In an exemplary embodiment, the display panel may further include another scan power line connected to at least one of the plurality of output terminals; and another plurality of scan signal lines each connected to another plural single-dimensional subset of the plurality of pixels, wherein each of the other plurality of scan signal lines is switchably connected to the other scan power line.

In an exemplary embodiment, the display panel may further include a plurality of power supply terminals each connected to the power distribution circuit, wherein the plurality of power supply terminals are configured in at least one of a per column configuration or a first and last row configuration.

In an exemplary embodiment, the display panel may further include a plurality of scan power lines each connected to at least one of the plurality of output terminals, wherein the plurality of scan power lines are configured in at least one of a per row configuration or a first and last column configuration.

BRIEF DESCRIPTION OF THE DRAWINGS

Illustrative, non-limiting exemplary embodiments will be more clearly understood from the following detailed description taken in conjunction with the accompanying drawings, in which.

DETAILED DESCRIPTION

Exemplary embodiments of the present disclosure are described more fully hereinafter with reference to the accompanying drawings. As used herein, like reference indicia may refer to like elements.

Figure 1:
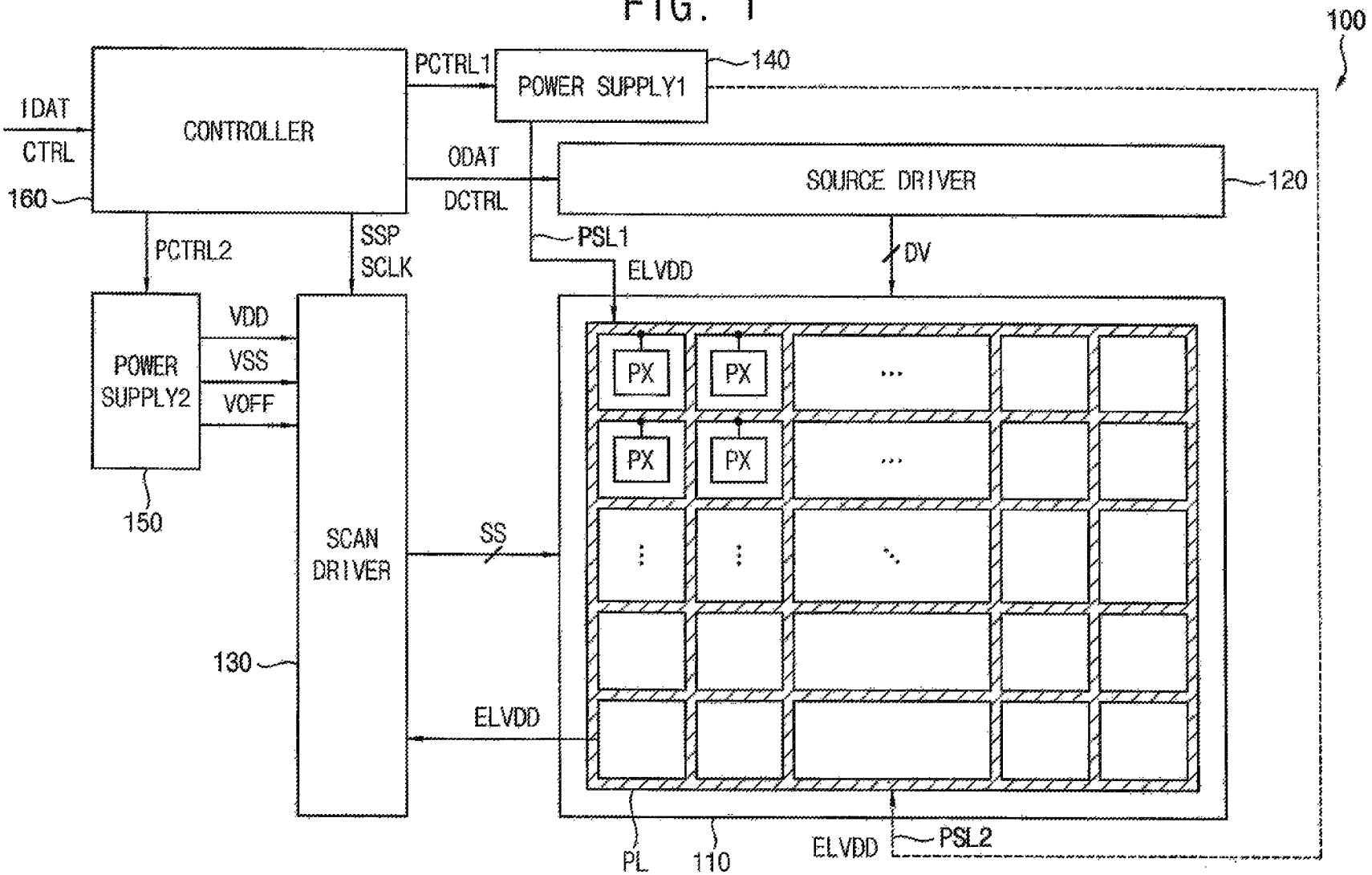
FIG. 1 is a partial schematic block diagram illustrating an organic light emitting diode (OLED) display device according to an exemplary embodiment.
Figure 2:
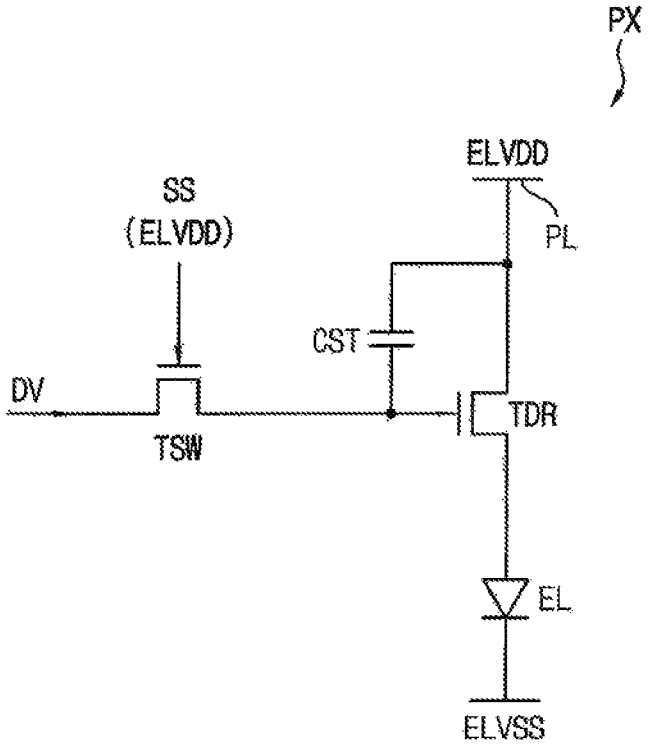
FIG. 2 is a schematic circuit diagram illustrating an example of a pixel included in an OLED display device according to an exemplary embodiment.
Figure 3:
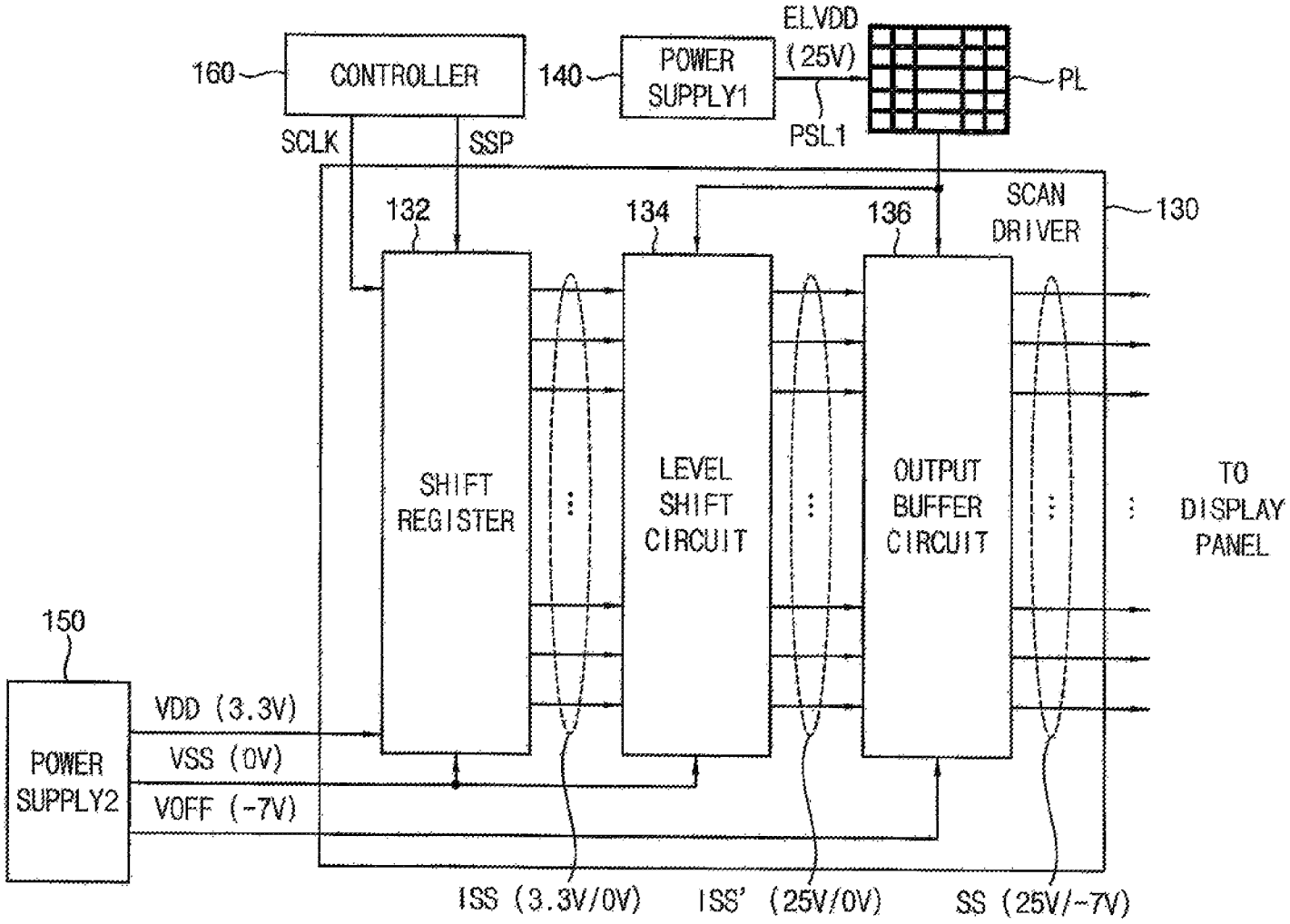
FIG. 3 is a schematic block diagram illustrating an example of a scan driver included in an OLED display device according to an exemplary embodiment.

FIG. 1 illustrates an organic light emitting diode (OLED) display device according to an exemplary embodiment, FIG. 2 illustrates an example of a pixel included in an OLED display device according to an exemplary embodiment, and FIG. 3 illustrates an example of a scan driver included in an OLED display device according to an exemplary embodiment.

Referring to FIG. 1, an OLED display device 100 according to an exemplary embodiment may include a first power supply circuit 140 that generates a pixel driving voltage ELVDD, a display panel 110 that includes a plurality of pixels PX emitting light based on the pixel driving voltage ELVDD, and a scan driver 130 that receives the pixel driving voltage ELVDD from the first power supply circuit 140, and provides the pixel driving voltage ELVDD as scan signals SS to the plurality of pixels PX. In an exemplary embodiment, the OLED display device 100 may further include a source driver 120, a second power supply circuit 150 and a controller 160.

The display panel 110 may include a plurality of data lines, a plurality of scan lines and the plurality of pixels PX coupled to the plurality of data lines and the plurality of scan lines. In an exemplary embodiment, each pixel PX may include at least one capacitor, at least two transistors and an OLED, and the display panel 110 may be an OLED display panel.

Although a two-dimensional (2-D) display device 100 and panel 110 have been shown and described with rows and columns for illustrative purposes, the present disclosure is not limited thereto. Alternate embodiments may be configured as three-dimensional (3-D) devices and/or panels with rows, columns, and levels, for example. In such 3-D embodiments, the grid or mesh power wiring structure of the device and/or panel may be similarly extended in all three dimensions, but is not limited thereto.

As illustrated in FIG. 2, each pixel PX may include a switching transistor TSW, a storage capacitor CST, a driving transistor TDR and the OLED EL. The switching transistor TSW may transfer a data voltage DV in response to the scan signal SS having an on level. In an exemplary embodiment, the scan signal SS on level may be the pixel driving voltage ELVDD (e.g., a high-level power supply voltage ELVDD for the OLED EL). For example, the switching transistor TSW may include a gate receiving the scan signal SS having the on level or the pixel driving voltage ELVDD through the scan line, a first terminal receiving the data voltage DV, and a second terminal coupled to the storage capacitor CST.

The storage capacitor CST may store the data voltage DV transferred through the switching transistor TSW. For example, the storage capacitor CST may include a first electrode coupled to a power wiring PL to which the pixel driving voltage ELVDD is applied, and a second electrode coupled to the second terminal of the switching transistor TSW.

The driving transistor TDR may be coupled to the power wiring PL to which the pixel driving voltage ELVDD is applied, and may generate a driving current corresponding to the data voltage DV stored in the storage capacitor CST based on the pixel driving voltage ELVDD provided through the power wiring PL. For example, the driving transistor TDR may include a gate coupled to the second electrode of the storage capacitor CST, a first terminal coupled to the power wiring PL, and a second terminal coupled to the OLED EL.

The OLED EL may emit light responsive to the driving current generated by the driving transistor TDR, which, in turn, is based on the pixel driving voltage ELVDD. For example, the OLED EL may include an anode coupled to the second terminal of the driving transistor TDR, and a cathode coupled to a line of a low-level power supply voltage ELVSS for the OLED EL.

In an exemplary embodiment, as illustrated in FIG. 2, the switching transistor TSW and the driving transistor TDR may be NMOS transistors, but are not limited thereto. Further, although FIG. 2 illustrates an example where each pixel PX has a 2T1C structure including two transistors TSW and TDR and one capacitor CST, the pixel PX according to alternate embodiments may have any suitable pixel structure.

Referring again to FIG. 1, in an exemplary embodiment, the display panel 110 may further include the power wiring PL for transferring the pixel driving voltage ELVDD to the plurality of pixels PX. In an exemplary embodiment, as illustrated in FIG. 1, the power wiring PL may have a grid-like or mesh circuit configuration, layout or structure.

In an exemplary embodiment, the power wiring PL may receive the pixel driving voltage ELVDD at a first side (e.g., a top side) of the display panel 110 through a first power supply line PSL1 from the first power supply circuit 140. For example, the OLED display device 100 may further include a first source film on which the source driver 120 is disposed, a first source board coupled to the first source film, a first flexible film coupled to the first source board, a control board coupled to the first flexible film, a second flexible film coupled to the control board, and a power board, on which the first power supply circuit 140 is disposed, coupled to the second flexible film, and the first power supply line PSL1 may be formed on the power board, the second flexible film, the control board, the first flexible film, the first source board and the first source film.

In an alternate embodiment, the first source film may be coupled to the first side (e.g., the top side) of the display panel 110, and the power wiring PL may receive the pixel driving voltage ELVDD at the first side of the display panel 110 through the first power supply line PSL1 from the first power supply circuit 140, and may further receive the pixel driving voltage ELVDD at a second side (e.g., a bottom side) opposite to the first side of the display panel 110 through a second power supply line PSL2 from the first power supply circuit 140. For example, the OLED display device 100 may further include a second source film, on which the source driver 120 is not disposed, coupled to the second side of the display panel 110, a second source board coupled to the second source film, and a third flexible film coupling the second source board and the control board, and the second power supply line PSL2 may be coupled to the first power supply line PSL1 on the control board, and may be formed on the third flexible film, the second source board and the second source film.

The source driver 120 may provide the data voltages DV to the plurality of pixels PX through the plurality of data lines based on output image data ODAT and a data control signal DCTRL received from the controller 160. In an exemplary embodiment, the data control signal DCTRL may include, but not limited to, an output data enable signal, a horizontal start signal and a load signal. In an exemplary embodiment, the source driver 120 may be implemented in the form of an integrated circuit (IC). For example, the source driver 120 implemented in the form of the IC may be referred to as a source IC or a data IC. Further, in an exemplary embodiment, the source driver 120 may be implemented as one or more source ICs.

The scan driver 130 may provide the scan signals SS to the plurality of pixels PX through the plurality of scan lines in response to a scan control signal received from the controller 160. In an exemplary embodiment, the scan control signal may include, but is not limited to, a scan start signal SSP and a scan clock signal SCLK. In an exemplary embodiment, the scan driver 130 may be implemented as one or more scan ICs. In an alternate embodiment, the scan driver 130 may be integrated or formed in a peripheral portion of the display panel 110. For example, the scan driver 130 may implemented as one or more oxide silicon gate (OSG) blocks integrated in the peripheral portion of the display panel 110.

The first power supply circuit 140 may generate the pixel driving voltage ELVDD based on a first power control signal PCTRL1 received from the controller 160. In an exemplary embodiment, the first power supply circuit 140 may apply the pixel driving voltage ELVDD to the power wiring PL at the first side (e.g., the top side) of the display panel 110 through the first power supply line PSL1. In an alternate embodiment, the first power supply circuit 140 may apply the pixel driving voltage ELVDD to the power wiring PL at the first side of the display panel 110 through the first power supply line PSL1, and may further apply the pixel driving voltage ELVDD to the power wiring PL at the second side (e.g., the bottom side) opposite to the first side of the display panel 110 through the second power supply line PSL2. In an exemplary embodiment, the pixel driving voltage ELVDD may be the high-level power supply voltage ELVDD for the OLED EL, and the first power supply circuit 140 may further generate the low-level power supply voltage ELVSS for the OLED EL. Further, in an exemplary embodiment, the first power supply circuit 140 may be, but is not limited to, a switch mode power supply (SMPS).

The second power supply circuit 150 may generate a gate off voltage VOFF based on a second power control signal PCTRL2 received from the controller 160. In an exemplary embodiment, the second power supply circuit 150 may further generate a digital high-level power supply voltage VDD (e.g., a high-level power supply voltage for a digital circuit) and a digital low-level power supply voltage VSS (e.g., a low-level power supply voltage for the digital circuit). The second power supply circuit 150 may provide the digital high-level power supply voltage VDD, the digital low-level power supply voltage VSS and the gate off voltage VOFF to the scan driver 130. In an exemplary embodiment, the second power supply circuit 150 may be implemented as, but not limited to, an IC. The IC of the second power supply circuit 150 may be referred to as a power management integrated circuit (PMIC). In an exemplary embodiment, the first and second power supply circuits 140 and 150 may be implemented as separate ICs. In an alternate embodiment, the first and second power supply circuits 140 and 150 may be implemented as a single IC.

The controller 160 (e.g., a timing controller (TCON)) may receive input image data IDAT and a control signal CTRL from an external host (e.g., a graphic processing unit (GPU) or a graphic card). In an exemplary embodiment, the control signal CTRL may include, but not limited to, a vertical synchronization signal, a horizontal synchronization signal, an input data enable signal, a master clock signal, or the like. The controller 160 may generate the output image data ODAT, the data control signal DCTRL, the scan control signal, the first power control signal PCTRL1 and the second power control signal PCTRL2 based on the input image data IDAT and the control signal CTRL. The controller 160 may control an operation of the source driver 120 by providing the output image data ODAT and the data control signal DCTRL to the source driver 120, may control an operation of the scan driver 130 by providing the scan control signal to the scan driver 130, may control an operation of the first power supply circuit 140 by providing the first power control signal PCTRL1 to the first power supply circuit 140, and may control an operation of the second power supply circuit 150 by providing the second power control signal PCTRL2 to the second power supply circuit 150.

In the OLED display device 100 according to an exemplary embodiment, the scan driver 130 may receive the pixel driving voltage ELVDD from the first power supply circuit 140. In an exemplary embodiment, the scan driver 130 may receive the pixel driving voltage ELVDD through the power wiring PL of the display panel 110 from the first power supply circuit 140. In an example, the scan driver 130 may receive the pixel driving voltage ELVDD through the first power supply line PSL1 and the power wiring PL of the display panel 110 from the first power supply circuit 140. In another example, the scan driver 130 may receive the pixel driving voltage ELVDD through the first power supply line PSL1 and the power wiring PL of the display panel 110 from the first power supply circuit 140, and may further receive the pixel driving voltage ELVDD through the second power supply line PSL2 and the power wiring PL of the display panel 110 from the first power supply circuit 140. Further, the scan driver 130 may provide the pixel driving voltage ELVDD as the scan signals SS to the plurality of pixels PX. In an exemplary embodiment, the scan driver 130 may further receive the gate off voltage VOFF from the second power supply circuit 150, may output the pixel driving voltage ELVDD as the scan signals SS having an on level, and may output the gate off voltage VOFF as the scan signals SS having an off level.

In an exemplary embodiment, as illustrated in FIG. 3, the scan driver 130 may include a shift register 132 and an output buffer circuit 136. The shift register 132 may receive the scan start signal SSP and the scan clock signal SCLK from the controller 160. The shift register 132 may sequentially generate internal scan signals ISS by shifting the scan start signal SSP in response to the scan clock signal SCLK. In an exemplary embodiment, the shift register 132 may receive, as power supply voltages, the digital high-level power supply voltage VDD and the digital low-level power supply voltage VSS from the second power supply circuit 150, and may operate based on the digital high-level power supply voltage VDD and the digital low-level power supply voltage VSS. For example, the digital high-level power supply voltage VDD may be, but is not limited to, about 3.3V, and the digital low-level power supply voltage VSS may be, but is not limited to, about 0V. In this case, the internal scan signal ISS having an on level may be, but is not limited to, about 3.3V, and the internal scan signal ISS having an off level may be, but is not limited to, about 0V.

The output buffer circuit 136 may receive the pixel driving voltage ELVDD from the first power supply circuit 140. For example, the power wiring PL of the display panel 110 may receive the pixel driving voltage ELVDD through the first power supply line PSL1 and/or the second power supply line PSL2 from the first power supply circuit 140, and the output buffer circuit 136 receive the pixel driving voltage ELVDD from the power wiring PL of the display panel 110. The output buffer circuit 136 may further receive the gate off voltage VOFF from the second power supply circuit 150. In response the internal scan signals ISS or ISS' that are sequentially activated, the output buffer circuit 136 may output the scan signals SS that are sequentially activated to the plurality of scan lines of the display panel 110. Further, the output buffer circuit 136 may output the pixel driving voltage ELVDD as the scan signals SS having the on level, and may output the gate off voltage VOFF as the scan signals SS having the off level. In an example, as illustrated in FIG. 3, the pixel driving voltage ELVDD may be, but is not limited to, about 25V, and the gate off voltage VOFF may be, but is not limited to, about −7V. In this case, the scan signal SS having the on level may be, but is not limited to, about 25V, and the scan signal SS having the off level may be, but is not limited to, about −7V. For example, the pixel driving voltage ELVDD and the scan signal SS having the on level may range from about 22V to about 25V, and the gate off voltage VOFF and the scan signal SS having the off level may range from about −7V to about −5V.

In an exemplary embodiment, the scan driver 130 may further include a level shift circuit 134. The level shift circuit 134 may receive the pixel driving voltage ELVDD through the power wiring PL of the display panel 110 from the first power supply circuit 140, and may receive the digital low-level power supply voltage VSS from the second power supply circuit 150. The level shift circuit 134 may increase a voltage level of the internal scan signals ISS output from the shift register 132 based on the pixel driving voltage ELVDD, and may provide the output buffer circuit 136 with the internal scan signals ISS' having the increased voltage level. For example, the internal scan signal ISS' having the on level output from the level shift circuit 134 may be, but is not limited to, about 25V, and the internal scan signal ISS' having the off level output from the level shift circuit 134 may be, but is not limited to, about 0V.

A scan driver of a non-preferred OLED display device may receive a gate on voltage through a single gate on voltage line from a power supply circuit, and may output the gate on voltage as a scan signal. However, due to a voltage drop (e.g., an IR drop) at the single gate on voltage line, the gate on voltage may be decreased as a distance from the power supply circuit increases. However, in the OLED display device 100 according to an exemplary embodiment, the scan driver 130 may receive the pixel driving voltage ELVDD through the power wiring PL of the display panel 110 from the first power supply circuit 140, and may provide the pixel driving voltage ELVDD as the scan signals SS to the plurality of pixels PX. Since the pixel driving voltage ELVDD may be transferred through the power wiring PL having the grid or mesh structure, the pixel driving voltage ELVDD may be more uniform compared with the non-preferred gate on voltage transferred through the single gate on voltage line. That is, instead of the non-preferred gate on voltage having a relatively large voltage drop, the pixel driving voltage ELVDD transferred through the power wiring PL may be used as the scan signal SS having the on level of the scan driver 130. Further, since the gate on voltage line may not be required in the OLED display device 100 according to an exemplary embodiment, the number of lines (or wirings) of the OLED display device 100 may be reduced, and a bezel width of the OLED display device 100 may be reduced.

Figure 4:
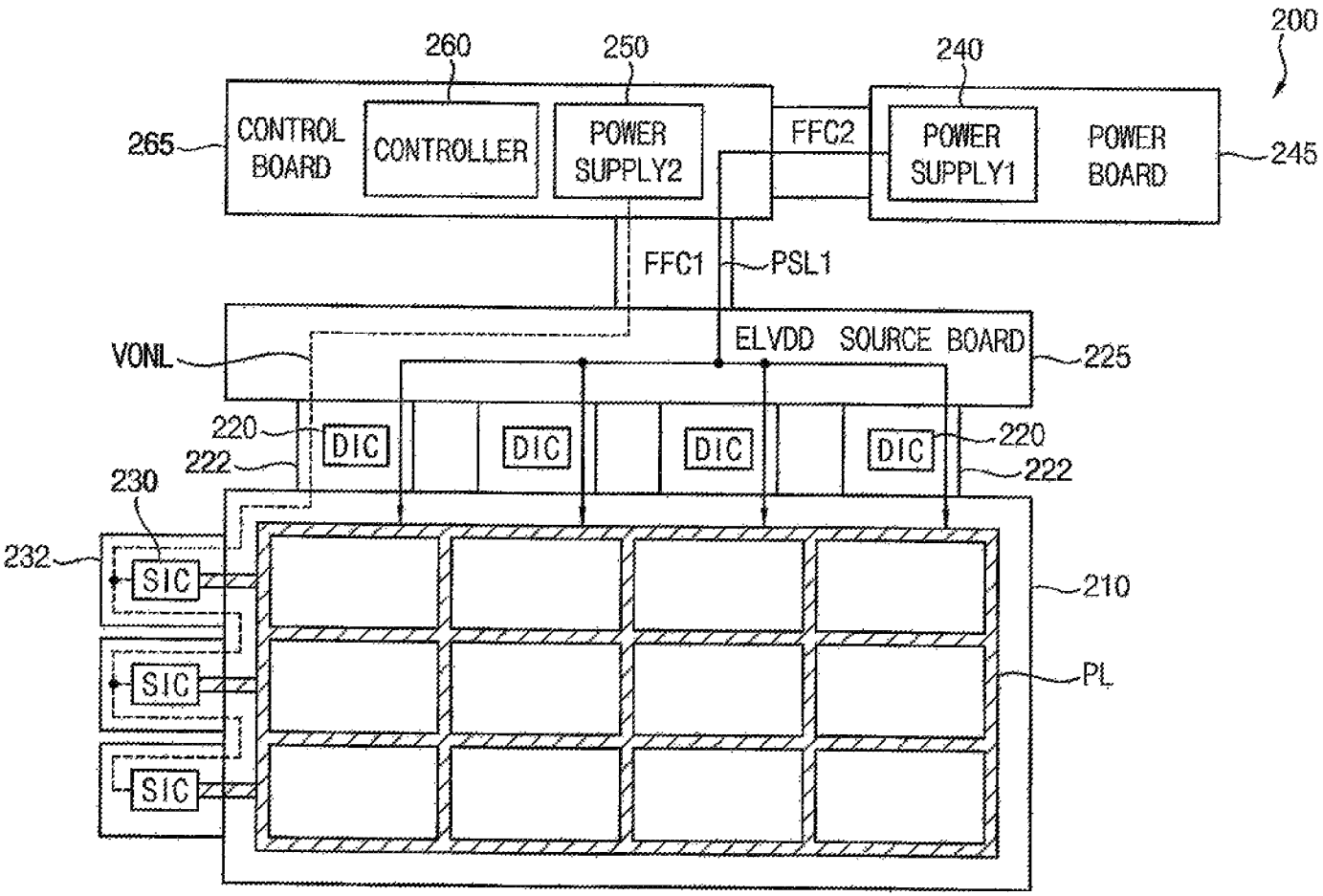
FIG. 4 is a partial schematic block diagram illustrating an OLED display device according to an exemplary embodiment.
Figure 5:
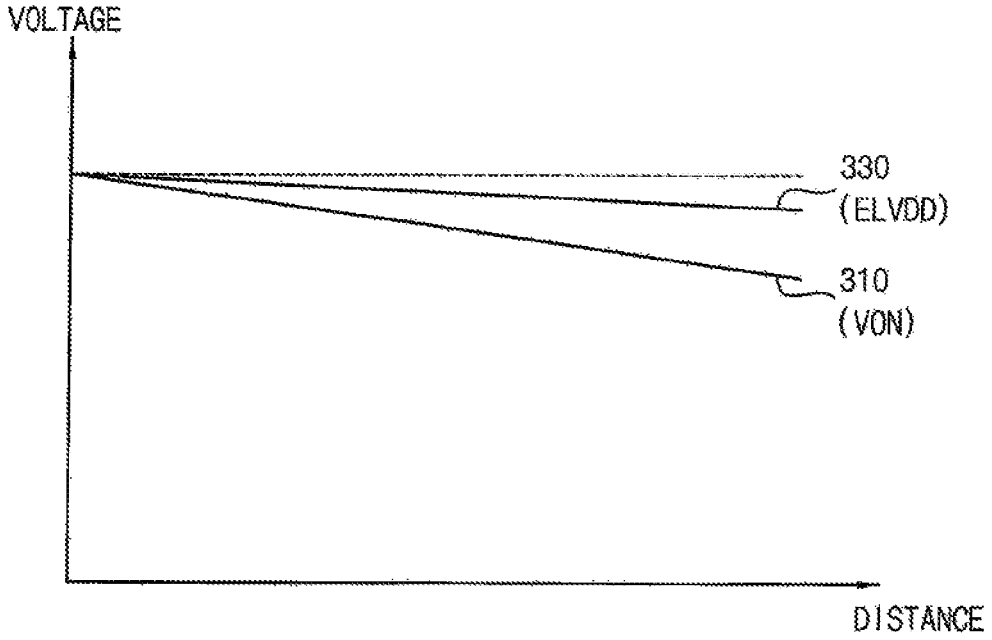
FIG. 5 is a graphical diagram illustrating a non-preferred gate on voltage applied to a scan driver through a gate on voltage line versus a pixel driving voltage applied to a scan driver in an OLED display device of FIG. 4.

FIG. 4 illustrates an OLED display device according to an exemplary embodiment, and FIG. 5 illustrates a non-preferred gate on voltage applied to a scan driver through a gate on voltage line and a pixel driving voltage applied to a scan driver in an OLED display device of FIG. 4.

Referring to FIG. 4, an OLED display device 200 according to an exemplary embodiment may include a display panel 210, a source driver 220, a source film 222, a source board 225, a first flexible film FFC1, a control board 265, a second flexible film FFC2, a first power supply circuit 240, a power board 245, a power supply line PSL1 and a scan driver 230. In an exemplary embodiment, the OLED display device 200 may further include a scan film 232, a second power supply circuit 250 and a controller 260.

The display panel 210 may include a plurality of pixels, and a power wiring PL for transferring a pixel driving voltage ELVDD to the plurality of pixels. In an exemplary embodiment, as illustrated in FIG. 4, the power wiring PL may have a grid or mesh structure.

The source driver 220 may provide data voltages to the plurality of pixels. In an exemplary embodiment, the source driver 220 may be implemented as a plurality of integrated circuits DIC. For example, the integrated circuits DIC of the source driver 220 may be referred to as source integrated circuits or data integrated circuits. The source driver 220 may be disposed on the source film 222 coupled to the display panel 210. For example, the source film 222 may be a flexible film, and the source driver 220 may be mounted on the source film 222 in a chip on film (COF) manner. In an exemplary embodiment, as illustrated in FIG. 4, a plurality of source integrated circuits DIC may be disposed on a plurality of source films 222.

The plurality of source films 222 may be coupled to the source board 225. For example, the source board 225 may be, but is not limited to, a source printed circuit board (PCB) or a source printed board assembly (PBA). The source board 225 may be coupled to the control board 265 through the first flexible film FFC1. For example, the first flexible film FFC1 may be, but is not limited to, a flexible flat cable (FFC) or a flexible printed circuit (FPC). Further, for example, the control board 265 may be, but is not limited to, a control PCB or a control PBA. The second power supply circuit 250 and the controller 260 may be disposed on the control board 265. In an exemplary embodiment, the second power supply circuit 250 may generate a gate off voltage, and the scan driver 230 may receive the gate off voltage from the second power supply circuit 250, and may output the gate off voltage as scan signals having an off level.

The control board 265 may be coupled to the power board 245 through the second flexible film FFC2. For example, the second flexible film FFC2 may be, but is not limited to, an FFC or an FPC. Further, the power board 245 may be, but is not limited to, a power PCB or a power PBA. Although FIG. 4 illustrates an example where the control board 265 and the power board 245 are separate boards, in an exemplary embodiment, the control board 265 and the power board 245 may be implemented with a single board. The first power supply circuit 240 generating the pixel driving voltage ELVDD may be disposed on the power board 245.

The scan driver 230 may provide the scan signals to the plurality of pixels. In an exemplary embodiment, as illustrated in FIG. 4, the scan driver 230 may be implemented as a plurality of integrated circuits SIC. For example, the integrated circuits SIC of the scan driver 230 may be referred to as scan integrated circuits or gate integrated circuits. The scan driver 230 may be disposed on the scan film 232 coupled to the display panel 210. For example, the scan film 232 may be a flexible film, and the scan driver 230 may be mounted on the scan film 232 in a COF manner. In an exemplary embodiment, as illustrated in FIG. 4, a plurality of scan integrated circuits SIC may be disposed on a plurality of scan films 232.

In a non-preferred OLED display device, a plurality of scan integrated circuits SIC may receive a gate on voltage through a single gate on voltage line VONL from a second power supply circuit 250. The single gate on voltage line VONL may be formed such that the single gate on voltage line VONL may bypass (or detour) the source integrated circuit DIC on the source film 222 and may pass outside the plurality of scan integrated circuits SIC on the plurality of scan films 232. In the non-preferred OLED display device, the gate on voltage may be applied in a multi-drop manner through the single gate on voltage line VONL.

However, in the OLED display device 200 according to an exemplary embodiment, the power supply line PSL1 may be formed on the power board 245, the second flexible film FFC2, the control board 265, the first flexible film FFC1, the source board 225 and the source film 222. The pixel driving voltage ELVDD generated by the first power supply circuit 240 may be applied to the power wiring PL through the power supply line PSL1. In an exemplary embodiment, as illustrated in FIG. 4, the power supply line PSL1 may be formed on the plurality of source films 222, and may apply the pixel driving voltage ELVDD to the power wiring PL at a plurality of positions. The scan driver 230, or the plurality of scan integrated circuits SIC may receive the pixel driving voltage ELVDD through the power supply line PSL1 and the power wiring PL of the display panel 210 from the first power supply circuit 240, and may provide the pixel driving voltage ELVDD as the scan signals to the plurality of pixels. That is, the scan driver 230 of the OLED display device 200 according to an exemplary embodiment may use the pixel driving voltage ELVDD received through the power wiring PL having a grid or mesh structure instead of the gate on voltage received through the single gate on voltage line VONL. For example, as indicated by 310 in FIG. 5, the gate on voltage VON received through the single gate on voltage line VONL may be relatively drastically decreased by a voltage drop (e.g. an IR drop) of the single gate on voltage line VONL as a distance from one side (e.g., a top side) of the display panel 210 increases. However, as indicated by 330 in FIG. 5, the pixel driving voltage ELVDD received through the power wiring PL having the grid or mesh structure may be relatively gently decreased as the distance from the one side (e.g., the top side) of the display panel 210 increases. Accordingly, in the OLED display device 200 according to an exemplary embodiment, the substantially uniform pixel driving voltage ELVDD may be applied to the scan driver 230, or the plurality of scan integrated circuits SIC through the power wiring PL having the grid or mesh structure, and the scan driver 230 may output the substantially uniform pixel driving voltage ELVDD as the scan signals. Further, since the OLED display device 200 may not have the gate on voltage line VONL, the number of lines (or wirings) of the OLED display device 200 may be reduced, and a bezel width of the OLED display device 200 may be reduced.

Figure 6:
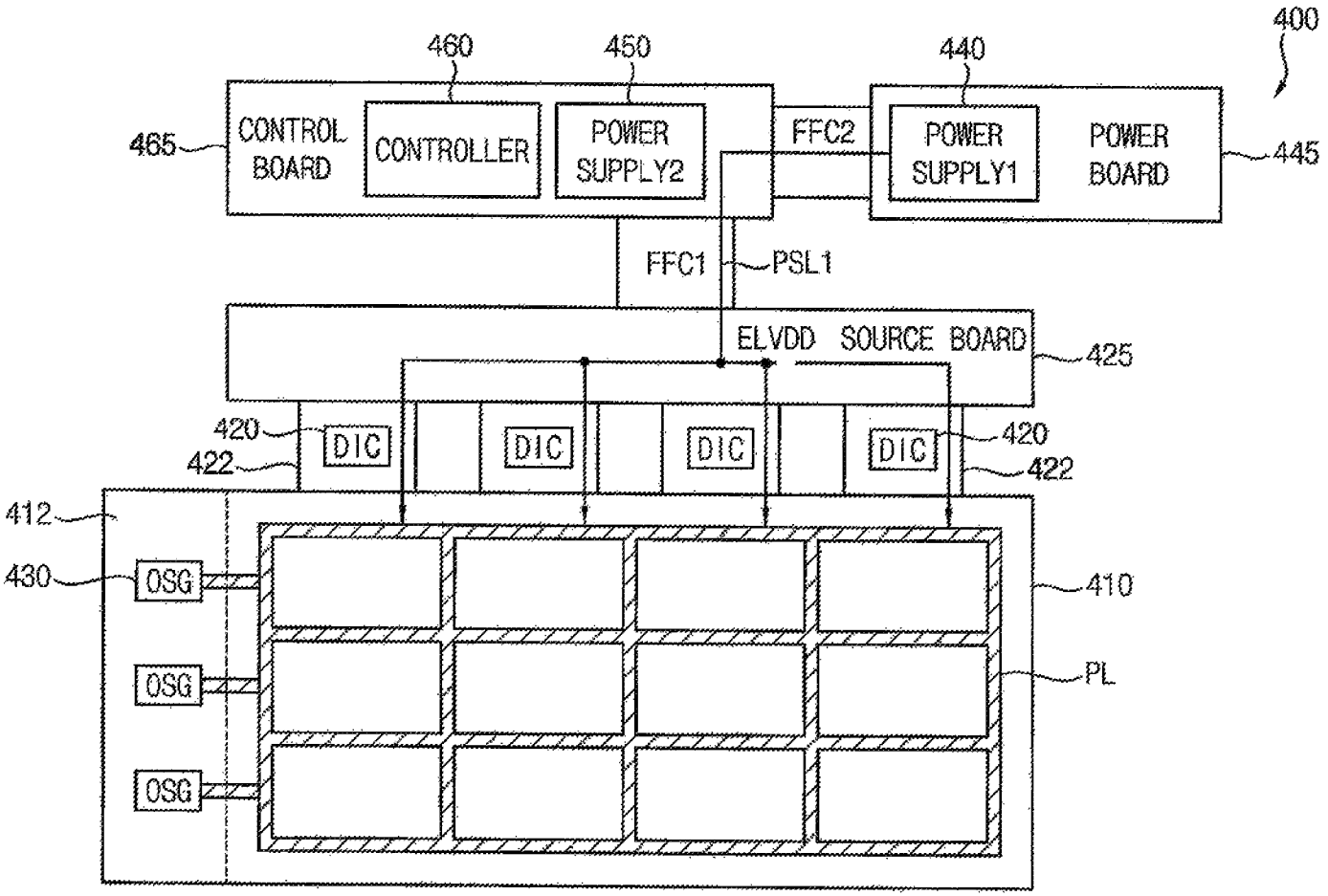
FIG. 6 is a partial schematic block diagram illustrating an OLED display device according to an exemplary embodiment.

FIG. 6 illustrates an OLED display device according to an exemplary embodiment.

Referring to FIG. 6, an OLED display device 400 according to an exemplary embodiment may include a display panel 410, a source driver 420, a source film 422, a source board 425, a scan driver 430, a first flexible film FFC1, a first power supply circuit 440, a power board 445, a second flexible film FFC2, a second power supply circuit 450, a controller 460, a control board 465 and a power supply line PSL1. The OLED display device 400 of FIG. 6 may have the substantially the same structure as an OLED display device 200 of FIG. 4, except that the scan driver 430 may be implemented as a plurality of blocks OSG integrated in a peripheral portion 412 of the display panel 410.

The scan driver 430 may be integrated or formed in the peripheral portion 412 of the display panel 410. In an exemplary embodiment, the scan driver 430 may be implemented as the plurality of blocks OSG integrated in the peripheral portion 412 of the display panel 410. For example, the plurality of blocks OSG may be, but are not limited to, a plurality of oxide silicon gate blocks.

As illustrated in FIG. 6, in the OLED display device 400 according to an exemplary embodiment, the scan driver 430, or the plurality of oxide silicon gate blocks OSG may receive a pixel driving voltage ELVDD through the power supply line PSL1 and a power wiring PL of the display panel 410 from the first power supply circuit 440, and may provide the pixel driving voltage ELVDD as scan signals to a plurality of pixels. Accordingly, in the OLED display device 400 according to an exemplary embodiment, the substantially uniform pixel driving voltage ELVDD may be applied to the scan driver 430, or the plurality of oxide silicon gate blocks OSG through the power wiring PL having a grid or mesh structure, and the scan driver 430 may output the substantially uniform pixel driving voltage ELVDD as the scan signals. Further, since the OLED display device 400 may not have a gate on voltage line, the number of lines (or wirings) of the OLED display device 400 may be reduced, and a bezel width of the OLED display device 400 may be reduced.

Figure 7:
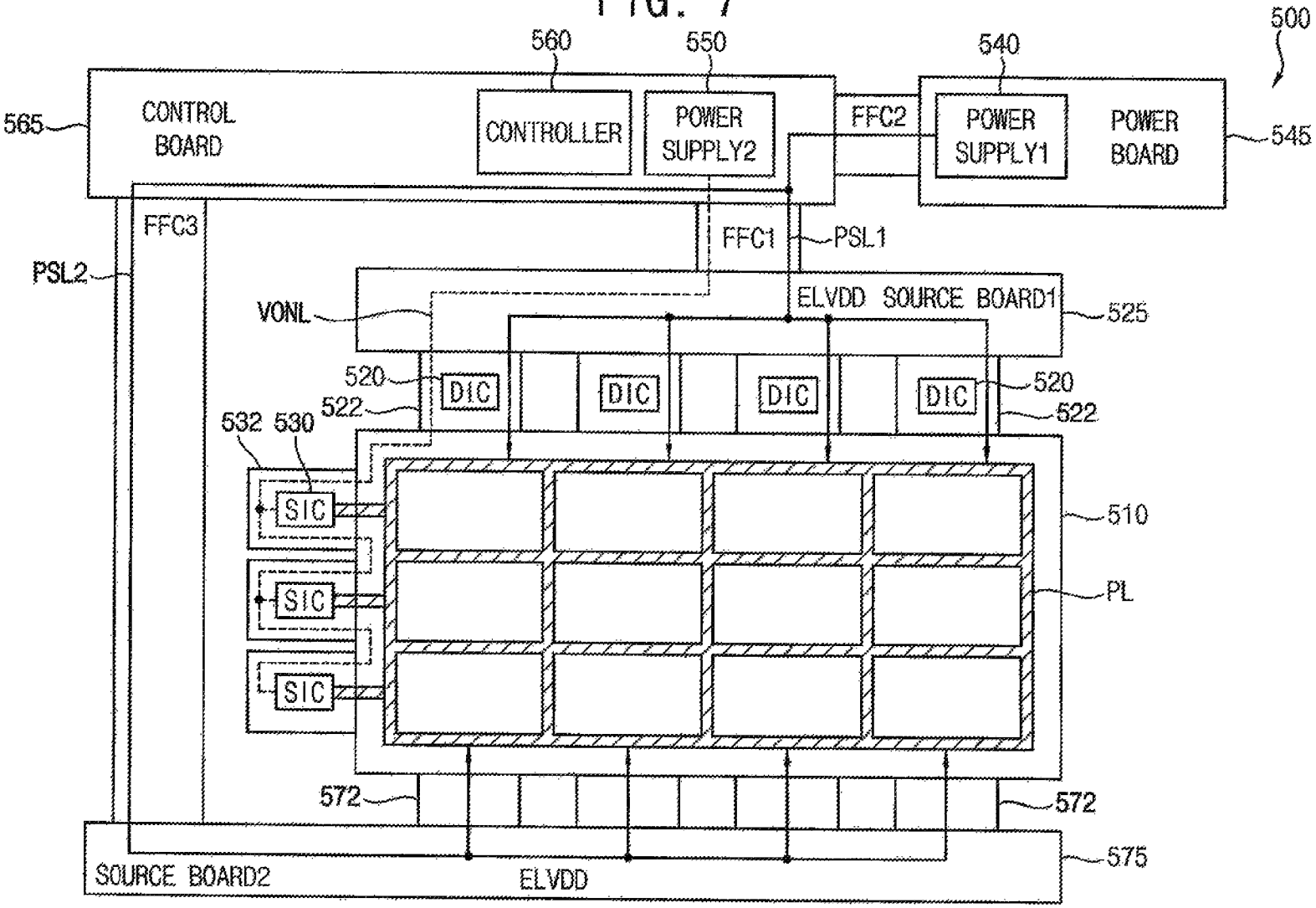
FIG. 7 is a partial schematic block diagram illustrating an OLED display device according to an exemplary embodiment.
Figure 8:
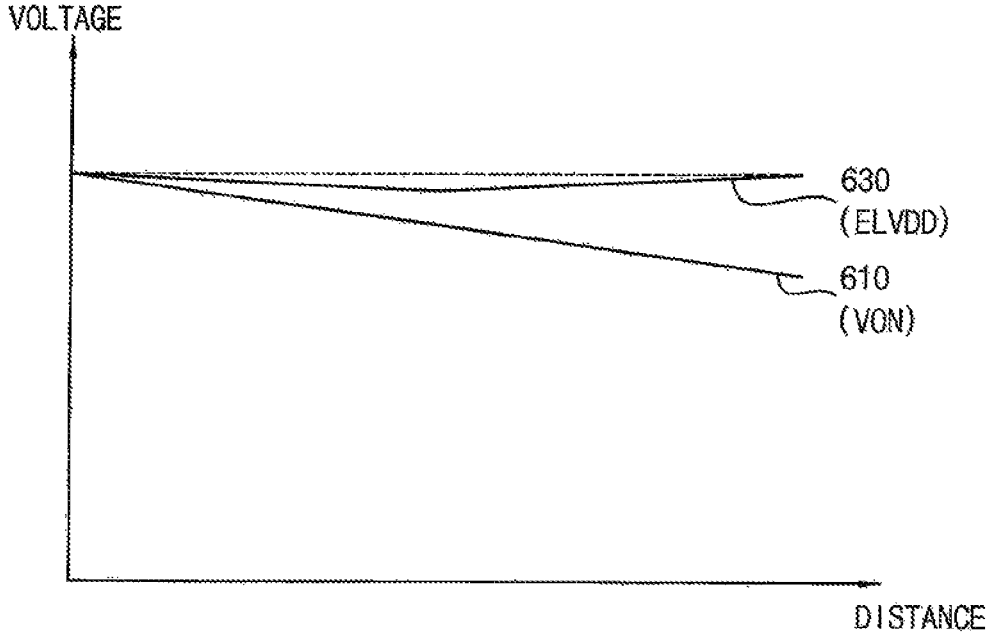
FIG. 8 is a graphical diagram illustrating a non-preferred gate on voltage applied to a scan driver through a gate on voltage line versus a pixel driving voltage applied to a scan driver in an OLED display device of FIG. 7.

FIG. 7 illustrates an OLED display device according to an exemplary embodiment, and FIG. 8 illustrates a non-preferred gate on voltage applied to a scan driver through a gate on voltage line and a pixel driving voltage applied to a scan driver in an OLED display device of FIG. 7.

Referring to FIG. 7, an OLED display device 500 according to an exemplary embodiment may include a display panel 510, a source driver 520, a first source film 522, a first source board 525, a first flexible film FFC1, a control board 565, a second flexible film FFC2, a first power supply circuit 540, a power board 545, a first power supply line PSL1, a second source film 572, a second source board 575, a third flexible film FFC3, a second power supply line PSL2 and a scan driver 530. In an exemplary embodiment, the OLED display device 500 may further include a scan film 532, a second power supply circuit 550 and a controller 560. Compared with an OLED display device 200 of FIG. 4, the OLED display device 500 of FIG. 7 may further include the third flexible film FFC3, the second source board 575, the second source film 572, and the second power supply line PSL2 formed on the third flexible film FFC3, the second source board 575 and the second source film 572.

The first source film 522 on which the source driver 520 is disposed may be coupled to a first side (e.g., a top side) of the display panel 510. Further, the first power supply line PSL1 may be formed on the power board 540, the second flexible film FFC2, the control board 565, the first flexible film FFC1, the first source board 525 and the first source film 522, and may to apply a pixel driving voltage ELVDD to a power wiring PL at the first side of the display panel 510.

The second source film 572 may be coupled to a second side (e.g., a bottom side) opposite to the first side of the display panel 510. For example, the second source film 572 may be a flexible film. In an exemplary embodiment, the source driver 520 may not be disposed on the second source film 572. The second source board 575 may be coupled to the second source film 572, and may be coupled to the control board 565 through the third flexible film FFC3. For example, the second source board 575 may be, but is not limited to, a source PCB or a source PBA. Further, the third flexible film FFC3 may be, but is not limited to, an FFC or an FPC. The second power supply line PSL2 may be coupled to the first power supply line PSL1 on the control board 565, and may be formed on the third flexible film FFC3, the second source board 575 and the second source film 572. Thus, the second power supply line PSL2 may apply the pixel driving voltage ELVDD to the power wiring PL at the second side opposite to the first side of the display panel 510.

Accordingly, the scan driver 530, or a plurality of scan integrated circuits SIC may receive the pixel driving voltage ELVDD through the first power supply line PSL1 and the power wiring PL of the display panel 510 from the first power supply circuit 540, may further receive the pixel driving voltage ELVDD through the second power supply line PSL2 and the power wiring PL of the display panel 510 from the first power supply circuit 540, and may provide the pixel driving voltage ELVDD as scan signals to a plurality of pixels of the display panel 510. That is, the scan driver 530 of the OLED display device 500 according to an exemplary embodiment may use the pixel driving voltage ELVDD received through the power wiring PL having a grid or mesh structure instead of a gate on voltage received through a single gate on voltage line VONL. For example, as indicated by 610 in FIG. 8, the gate on voltage VON received through the single gate on voltage line VONL may be relatively drastically decreased by a voltage drop (e.g. an IR drop) of the single gate on voltage line VONL as a distance from one side (e.g., the top side) of the display panel 510 increases. However, as indicated by 630 in FIG. 8, the pixel driving voltage ELVDD received through the power wiring PL having the grid or mesh structure to which the pixel driving voltage ELVDD is applied at both sides of the display panel 510 may be relatively gently decreased, and then may be relatively gently increased as the distance from the one side (e.g., the top side) of the display panel 510 increases. Accordingly, in the OLED display device 500 according to an exemplary embodiment, the substantially uniform pixel driving voltage ELVDD may be applied to the scan driver 530, or the plurality of scan integrated circuits SIC through the power wiring PL having the grid or mesh structure, and the scan driver 530 may output the substantially uniform pixel driving voltage ELVDD as the scan signals. Further, since the OLED display device 500 may not have the gate on voltage line VONL, the number of lines (or wirings) of the OLED display device 500 may be reduced, and a bezel width of the OLED display device 500 may be reduced.

FIG. illustrates an OLED display device according to an exemplary embodiment.

Figure 9:
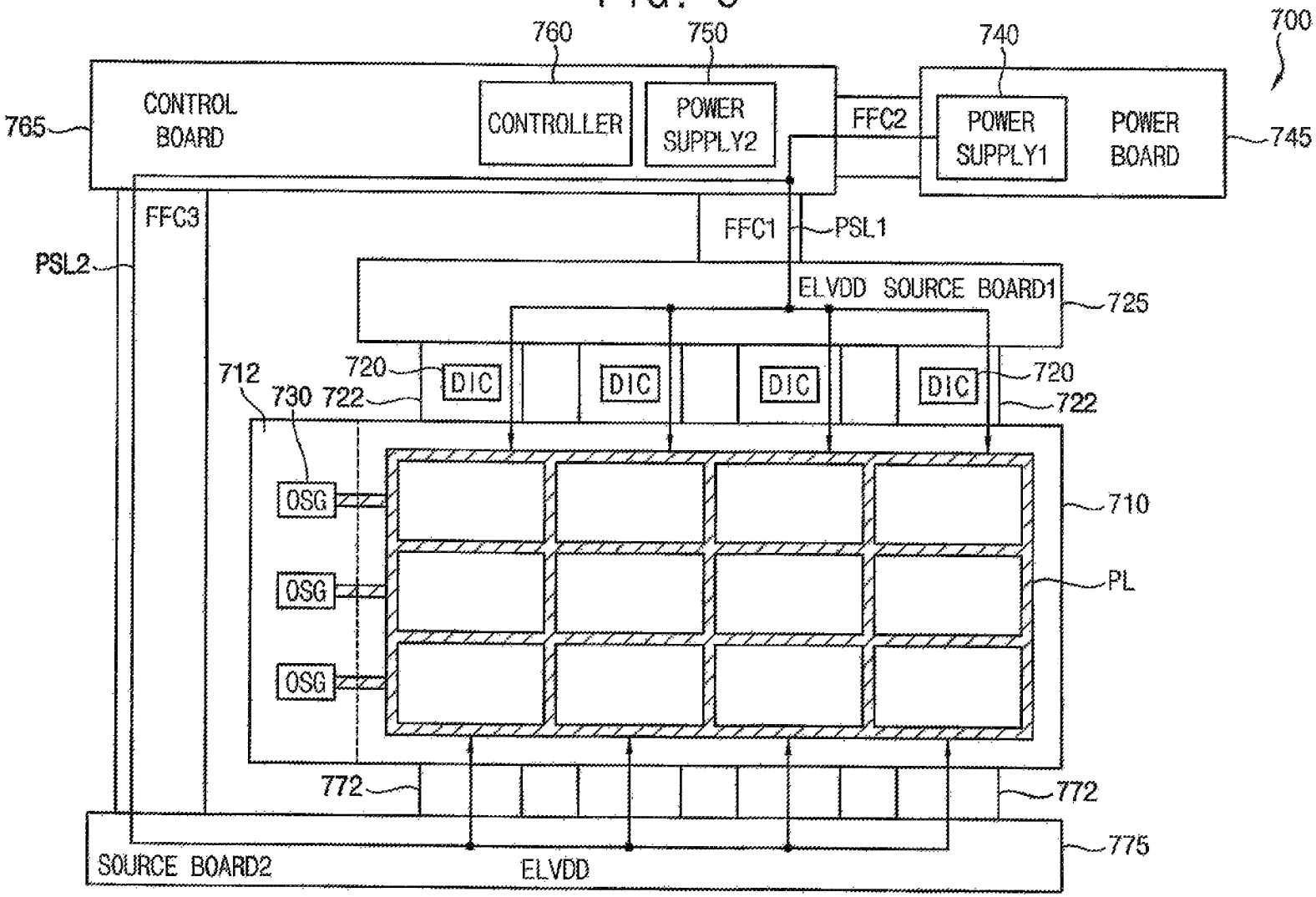
FIG. 9 is a partial schematic block diagram illustrating an OLED display device according to an exemplary embodiment.

Referring to FIG. 9, an OLED display device 700 according to an exemplary embodiment may include a display panel 710, a source driver 720, a first source film 722, a first source board 725, a first flexible film FFC1, a scan driver 730, a first power supply circuit 740, a power board 745, a second flexible film FFC2, a second power supply circuit 750, a controller 760, a control board 765, a first power supply line PSL1, a second source film 772, a second source board 775, a third flexible film FFC3 and a second power supply line PSL2. The OLED display device 700 of FIG. 9 may have the substantially the same structure as an OLED display device 500 of FIG. 7, except that the scan driver 730 may be implemented as a plurality of blocks OSG integrated in a peripheral portion 712 of the display panel 710.

The scan driver 730 may be integrated or formed in the peripheral portion 712 of the display panel 710. In an exemplary embodiment, the scan driver 730 may be implemented as the plurality of blocks OSG integrated in the peripheral portion 712 of the display panel 710. For example, the plurality of blocks OSG may be, but are not limited to, a plurality of oxide silicon gate blocks.

As illustrated in FIG. 9, in the OLED display device 700 according to an exemplary embodiment, the scan driver 730, or the plurality of oxide silicon gate blocks OSG may receive a pixel driving voltage ELVDD through the first power supply line PSL1 and a power wiring PL of the display panel 710 from the first power supply circuit 740, may further receive the pixel driving voltage ELVDD through the second power supply line PSL2 and the power wiring PL of the display panel 710 from the first power supply circuit 740, and may provide the pixel driving voltage ELVDD as scan signals to a plurality of pixels of the display panel 710. Accordingly, in the OLED display device 700 according to an exemplary embodiment, the substantially uniform pixel driving voltage ELVDD may be applied to the scan driver 730, or the plurality of oxide silicon gate blocks OSG through the power wiring PL having a grid or mesh structure, and the scan driver 730 may output the substantially uniform pixel driving voltage ELVDD as the scan signals. Further, since the OLED display device 700 may not have a gate on voltage line, the number of lines (or wirings) of the OLED display device 700 may be reduced, and a bezel width of the OLED display device 700 may be reduced.

Figure 10:
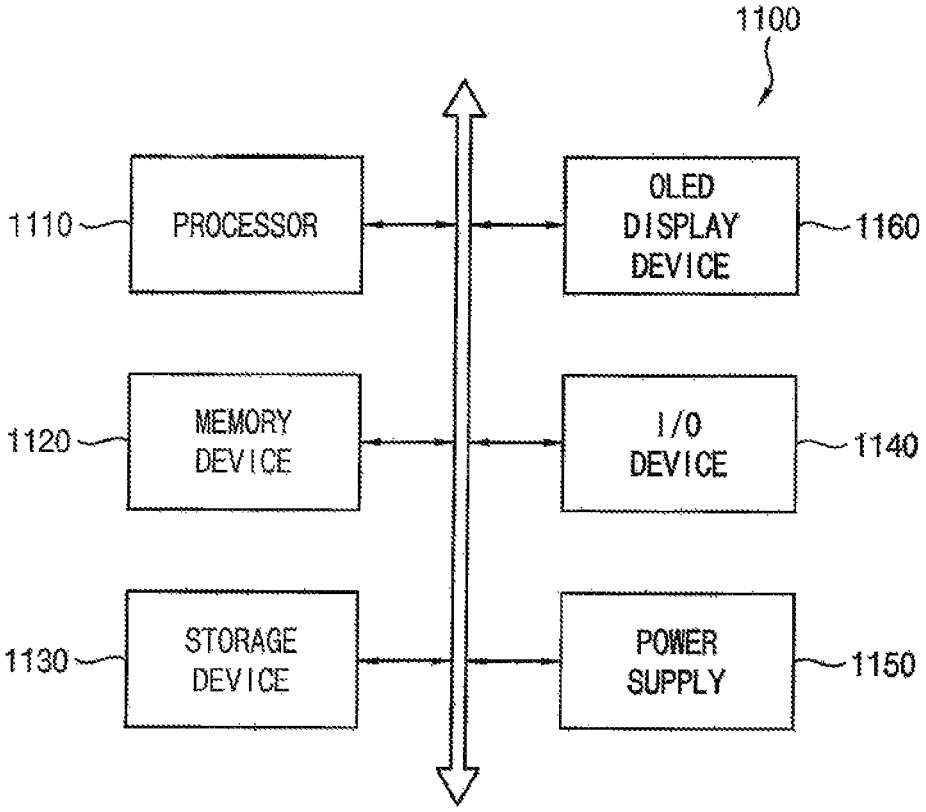
FIG. 10 is a schematic block diagram illustrating an example of an electronic device including an OLED display device according to an exemplary embodiment.

FIG. 10 illustrates an example of an electronic device including an OLED display device according to an exemplary embodiment.

Referring to FIG. 10, an electronic device 1100 may include a processor 1110, a memory device 1120, a storage device 1130, an input/output (I/O) device 1140, a power supply 1150, and an OLED display device 1160. The electronic device 1100 may further include a plurality of ports for communicating a video card, a sound card, a memory card, a universal serial bus (USB) device, other electric devices, or the like.

The processor 1110 may perform various computing functions or tasks. The processor 1110 may be an application processor (AP), a microprocessor, a central processing unit (CPU), or the like. The processor 1110 may be coupled to other components via an address bus, a control bus, a data bus, or the like. Further, in an exemplary embodiment, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, or the like, and/or at least one volatile memory device such as a dynamic random access memory (DRAM) device, a static random access memory (SRAM) device, a mobile dynamic random access memory (mobile DRAM) device, or the like.

The storage device 1130 may be a solid-state drive (SSD) device, a hard disk drive (HDD) device, a CD-ROM device, or the like. The I/O device 1140 may be an input device such as a keyboard, a keypad, a mouse, a touch screen, or the like, and an output device such as a printer, a speaker, or the like. The power supply 1150 may supply power for operations of the electronic device 1100.

In the OLED display device 1160, a scan driver may receive a pixel driving voltage provided to a plurality of pixels, and may provide the pixel driving voltage as scan signals to the plurality of pixels. Accordingly, the pixel driving voltage having a relatively small voltage drop may be used instead of a gate on voltage having a relatively large voltage drop in the scan driver, and the number of lines (or wirings) and a bezel width of the OLED display device 1160 may be reduced.

According to an exemplary embodiment, the electronic device 1100 may be any electronic device including the OLED display device 1160, such as a cellular phone, a smart phone, a tablet computer, a wearable device, a personal digital assistant (PDA), a portable multimedia player (PMP), a digital camera, a music player, a portable game console, a navigation system, a digital television, a 3D television, a personal computer (PC), a home appliance, a laptop computer, or the like.

The foregoing is illustrative of the present disclosure and is not to be construed as limiting thereof. Although exemplary embodiments have been shown and described, those of ordinary skill in the pertinent art will readily appreciate that modifications are possible without materially departing from the novel teachings of the present disclosure. All such modifications are intended to be included within the scope of the inventive concept as defined by the appended claims. It is to be understood that the foregoing is illustrative of the inventive concept but is not to be construed as limited to the specific embodiments disclosed, and that modifications to the disclosed embodiments, as well as to alternate embodiments, are intended to be included within the scope and spirit of the appended claims and their equivalents.

What is claimed is:

1. An organic light emitting diode (OLED) display device comprising:

a first power supply circuit configured to generate a pixel driving voltage;

a display panel configured to receive the pixel driving voltage from the first power supply circuit, and including a plurality of pixels each configured to emit light based thereon; and a scan driver configured to receive the pixel driving voltage from the display panel, and to provide, as scan signals having an on level for turning on transistors of the plurality of pixels, the pixel driving voltage received from the display panel to the plurality of pixels, wherein the display panel further includes power wiring for transferring the pixel driving voltage to the plurality of pixels, wherein the first power supply circuit applies the pixel driving voltage to the power wiring of the display panel through a first power supply line, wherein the scan driver receives the pixel driving voltage through the first power supply line and the power wiring of the display panel from the first power supply circuit, wherein the OLED display device further comprises:

a source driver configured to provide data voltages to the plurality of pixels;

a first source film coupled to the display panel, the source driver disposed on the first source film;

a first source board coupled to the first source film;

a first flexible film coupled to the first source board;

a control board coupled to the first flexible film;

a second flexible film coupled to the control board; and a power board coupled to the second flexible film, the first power supply circuit disposed on the power board, and wherein the first power supply line is formed on the power board, the second flexible film, the control board, the first flexible film, the first source board and the first source film.

2. The OLED display device of claim 1, wherein the power wiring of the display panel has a grid structure.

3. The OLED display device of claim 1, wherein each of the plurality of pixels includes:

a switching transistor configured to transfer a data voltage in response to the scan signals from the scan driver;

a storage capacitor configured to store the data voltage transferred through the switching transistor;

a driving transistor coupled to the power wiring, and configured to generate a driving current corresponding to the data voltage stored in the storage capacitor based on the pixel driving voltage provided through the power wiring; and an OLED configured to emit light based on the driving current.

4. The OLED display device of claim 1, further comprising:

a second power supply circuit configured to generate a gate off voltage, wherein the scan driver further receives the gate off voltage from the second power supply circuit, outputs the pixel driving voltage as the scan signals having the on level, and outputs the gate off voltage as the scan signals having an off level.

5. The OLED display device of claim 4, further comprising:

a controller configured to control the scan driver by providing a scan start signal and a scan clock signal to the scan driver.

6. The OLED display device of claim 5, wherein the scan driver includes:

a shift register configured to sequentially generate internal scan signals by shifting the scan start signal in response to the scan clock signal; and an output buffer circuit configured to receive the pixel driving voltage through the display panel from the first power supply circuit, to further receive the gate off voltage from the second power supply circuit, to output the pixel driving voltage as the scan signals having the on level in response to the internal scan signals, and to output the gate off voltage as the scan signals having the off level.

7. The OLED display device of claim 6, wherein the second power supply circuit further generates a digital high-level power supply voltage and a digital low-level power supply voltage, and wherein the shift register operates based on the digital high-level power supply voltage and the digital low-level power supply voltage received from the second power supply circuit.

8. The OLED display device of claim 6, wherein the scan driver further includes:

a level shift circuit configured to receive the pixel driving voltage from the first power supply circuit, to increase a voltage level of the internal scan signals output from the shift register based on the pixel driving voltage, and to provide the output buffer circuit with the internal scan signals having the increased voltage level.

9. The OLED display device of claim 1, wherein the first source film is coupled to a first side of the display panel, and wherein the first power supply circuit applies the pixel driving voltage to the power wiring at the first side of the display panel through the first power supply line, and further applies the pixel driving voltage to the power wiring at a second side opposite to the first side of the display panel through a second power supply line.

10. The OLED display device of claim 9, further comprising:

a second source film coupled to the second side of the display panel, the source driver being not disposed on the second source film;

a second source board coupled to the second source film; and a third flexible film coupling the second source board and the control board, wherein the second power supply line is coupled to the first power supply line on the control board, and is formed on the third flexible film, the second source board and the second source film.

11. An organic light emitting diode (OLED) display device comprising:

a display panel including a plurality of pixels, and a power wiring for transferring a pixel driving voltage to the plurality of pixels;

a source driver configured to provide data voltages to the plurality of pixels;

a source film coupled to the display panel, the source driver disposed on the source film;

a source board coupled to the source film;

a first flexible film coupled to the source board;

a control board coupled to the first flexible film;

a second flexible film coupled to the control board;

a first power supply circuit configured to generate the pixel driving voltage;

a power board coupled to the second flexible film, the first power supply circuit disposed on the power board;

a power supply line formed on the power board, the second flexible film, the control board, the first flexible film, the source board and the source film, and configured to apply the pixel driving voltage generated by the first power supply circuit to the power wiring of the display panel; and a scan driver configured to receive the pixel driving voltage through the power supply line and the power wiring of the display panel from the first power supply circuit, and to provide the pixel driving voltage as scan signals to the plurality of pixels.

12. A display device comprising:

a power supply circuit configured to generate a pixel driving voltage;

a display panel comprising:

a power distribution circuit having at least one power supply terminal for receiving the pixel driving voltage and a plurality of output terminals;

a plurality of pixels connected to the plurality of output terminals; and at least one scan power line connected to at least one of the plurality of output terminals; and a scan driver configured to receive the pixel driving voltage through the at least one scan power line of the display panel, and to provide, as scan signals having an on level for turning on transistors of the plurality of pixels, the pixel driving voltage received from the display panel to the plurality of pixels.

13. The display device of claim 12, wherein:

the plurality of pixels are arranged in a multi-dimensional matrix, and the power distribution circuit extends along each orthogonal dimension of the matrix and is interconnected at each vertex of the matrix.

14. The display device of claim 12, wherein the display panel further comprises:

a plurality of scan signal lines each connected to a plural single-dimensional subset of the plurality of pixels, and wherein each of the plurality of scan signal lines is switchably connected to the at least one scan power line.

15. The display device of claim 12, wherein the display panel further comprises:

another scan power line connected to at least one of the plurality of output terminals; and another plurality of scan signal lines each connected to another plural single-dimensional subset of the plurality of pixels, and wherein each of the other plurality of scan signal lines is switchably connected to the other scan power line.

16. The display device of claim 12, wherein the display panel further comprises:

a plurality of power supply terminals each connected to the power distribution circuit, and wherein the plurality of power supply terminals are configured in at least one of a per column configuration or a first and last row configuration.

17. The display device of claim 12, wherein the display panel further comprises a plurality of scan power lines each connected to at least one of the plurality of output terminals, and wherein the plurality of scan power lines are configured in at least one of a per row configuration or a first and last column configuration.

* * * * *